US008177339B2

(12) United States Patent
Stephens et al.

(10) Patent No.: US 8,177,339 B2
(45) Date of Patent: May 15, 2012

(54) FLUID RESERVOIR WITH COMPLIANT WALL

(75) Inventors: Terrance L. Stephens, Molalla, OR (US); Jonathan R. Brick, Tualatin, OR (US); John R. Andrews, Fairport, NY (US); David P. Platt, Sherwood, OR (US); David R. Koehler, Sherwood, OR (US); Christopher J. Laharty, Oregon City, OR (US)

(73) Assignee: Xerox Corporation, Norwalk, CT (US)

( * ) Notice: Subject to any disclaimer, the term of this patent is extended or adjusted under 35 U.S.C. 154(b) by 939 days.

(21) Appl. No.: 12/194,488

(22) Filed: Aug. 19, 2008

(65) Prior Publication Data

US 2010/0045754 A1 Feb. 25, 2010

(51) Int. Cl.
*B41J 2/175* (2006.01)

(52) U.S. Cl. ..... 347/85; 347/86

(58) Field of Classification Search ..... 347/40–43, 347/49, 50, 58–59, 64–65, 67, 71, 84–85, 347/94

See application file for complete search history.

(56) References Cited

U.S. PATENT DOCUMENTS 6,695,442 B2 * 2/2004 Kitahara ..... 347/92

* cited by examiner

*Primary Examiner* — Thinh Nguyen

(74) *Attorney, Agent, or Firm* — Marger Johnson & McCollom PC

(57) ABSTRACT

A fluid dispensing assembly has a fluid reservoir, a reservoir structure having at least one opening corresponding to a location of at least one fluid chamber in the reservoir structure, and a compliant film arranged to seal the opening and flex in response to pressure fluctuations in the fluid chamber. A system has a fluid supply, a fluid dispensing assembly having a fluid reservoir to receive fluid from the fluid supply, the fluid dispensing assembly having a reservoir structure with at least one opening corresponding to at least one fluid chamber, and a compliant film arranged to cover the opening such that a side of the film contacts fluid in the chamber and a side opposite the side contacting the fluid contacts air and is arranged to allow the film to flex.

15 Claims, 4 Drawing Sheets

FLUID RESERVOIR WITH COMPLIANT WALL

BACKGROUND

Some fluid dispensing assemblies use transducers or actuator to cause the system to dispense fluid. The actuators may be piezoelectric actuators, microelectromechanical (MEMS) actuators, thermomechanical actuators, thermal phase change actuators, etc. The actuators generally cause some sort of interface with the fluid to move to generate pressure in the fluid that in turn causes the fluid to move through an aperture to a receiving substrate.

In addition to causing the assembly to dispense or dispel fluid, the actuators may also create pressure oscillations that propagate into the fluid supply. These pressure oscillations give rise to droplet position errors, missing droplets, etc.

One example of such a fluid dispensing system is an ink jet printer. Generally, ink jet printers include some sort of transducer or actuator that cause the ink to move out of the print head through a jet, nozzle or other orifice to form a drop on a print surface. The firing of multiple actuators can lead to pressure oscillations, also referred to as acoustic waves, that propagate through the system. Pressure oscillations result in position errors, affecting the accuracy of the resulting print, missing ink droplets, affecting the color density of the print, and color density bands in prints.

DETAILED DESCRIPTION OF THE EMBODIMENTS

Some fluid dispensing assemblies include a local fluid supply and a fluid dispensing subassembly. The local fluid supply may reside in one or more reservoir chamber or chambers within a reservoir assembly. The fluid dispensing subassembly may be viewed as having several components. First, the driver component may consist of the transducer, such as a piezoelectric transducer, that causes the fluid to exit the subassembly, the diaphragm upon which the transducer operates, and the body plate or plates that form the pressure chamber. Second, an inlet component consists of the manifold body that direct the fluid from the manifold toward the pressure chamber. Next, the outlet component directs the fluid from the pressure chamber to the aperture. Finally, the aperture itself dispenses fluid out of the printhead.

A print head serves as an example of a fluid dispensing assembly, with a jet stack acting as the fluid dispensing subassembly. In the printhead/jet stack example, the four components of driver, inlet, outlet and aperture become more specific. The inlet would direct the ink from a manifold towards a pressure chamber, and the outlet would direct the ink from the pressure chamber to the aperture plate. The driver would operate on the ink in the pressure chamber to cause the fluid to exit the jet stack through the aperture plate.

In the example of a jet stack, the aperture would dispense fluid out of the jet stack and ultimately out of the print head.

The term printer as used here applied to any type of drop-on-demand ejector system in which drops of fluid are forced through one aperture in response to actuation of some sort of transducer. This includes printers, such as thermal ink jet printers, print heads used in applications such as organic electronic circuit fabrication, bioassays, three-dimensional structure building systems, etc. The term 'printhead' is not intended to only apply to printers and no such limitation should be implied. The jet stack resides within the print head of a printer, with the term printer including the examples above.

Figure 1:
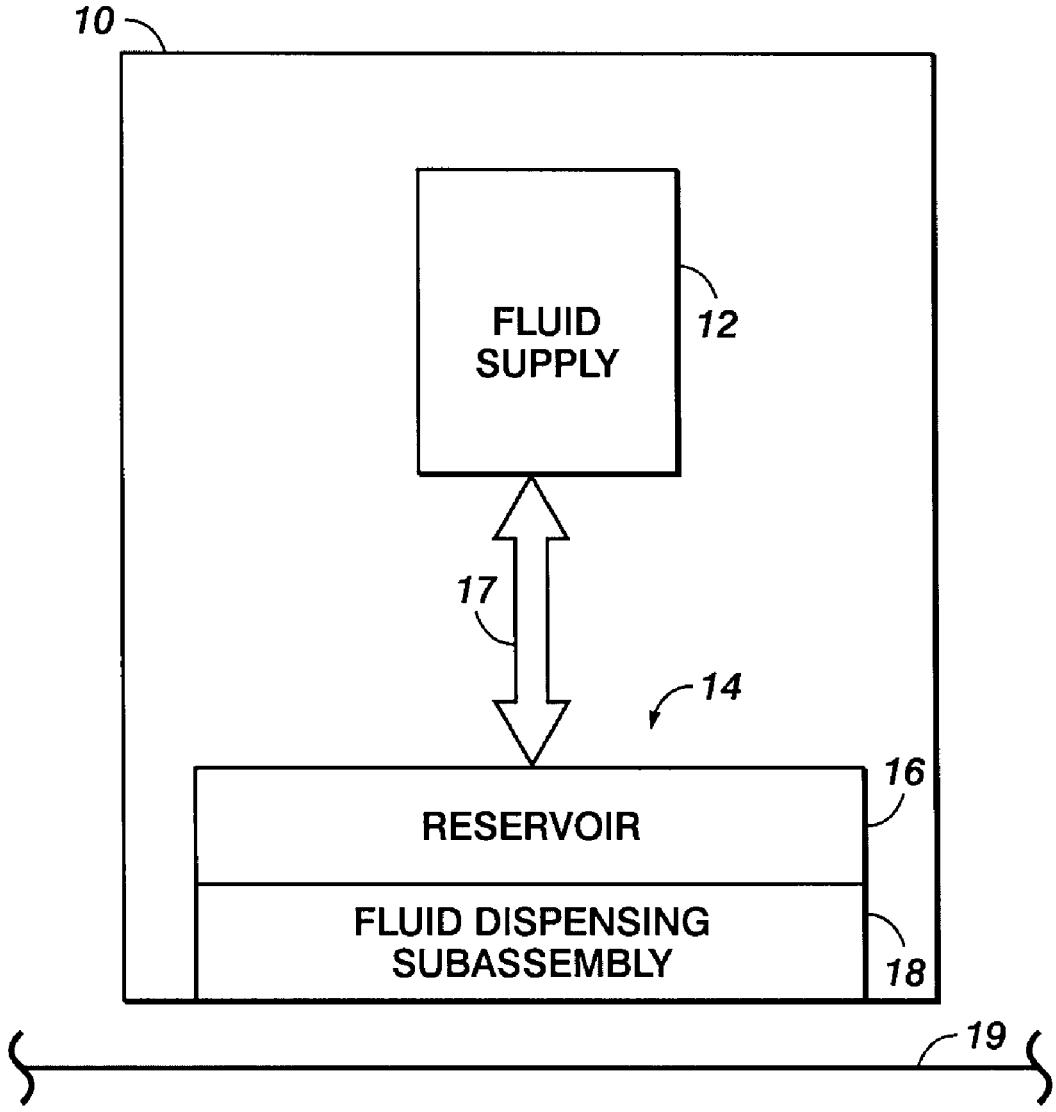
FIG. 1 shows a block diagram example of an ink jet printer.

FIG. 1 shows a block diagram of one embodiment of a system having a fluid dispensing assembly that includes a fluid dispensing subassembly. In this embodiment, the fluid dispensing assembly may be a printhead in a printer, but no limitation should be implied, nor is any intended. The configuration of the printer is merely to aid in understanding of the context of the implementation of the invention. Further, the examples discussed herein may refer to ink instead of fluid and a jet stack instead of a fluid dispensing subassembly. Again, no limitation is intender nor should be implied.

The system 10 has a fluid supply 12 that has an umbilical or conduit 17 that transfers the fluid to a fluid dispensing assembly 14. The system 10 may have a solid ink supply 12 in which the ink or inks are inserted in solid or "stick" form. The ink supply 12 would have a heater, not shown, that melts the ink. In this instance, the conduit 17 would be heated as it transfers the melted ink to the print head 14.

The print head has a local ink supply, stored in a reservoir assembly 16. The reservoir assembly comprises a reservoir chamber and the compliant film, as will be discussed in more detail further. For color printers, there will generally be four reservoir chambers in the ink supply, four umbilicals transferring ink from the print supply to the print head, and four ink chambers within the local reservoir assembly 16. Fluid transfers from the reservoir assembly 16 to the fluid dispensing subassembly 18. As mentioned above, the fluid dispensing subassembly may consist of a jet stack in a print head.

The aperture plate has an array of apertures or nozzles that allow ink to pass from the ink reservoirs through the jet stack to the print surface 19. The determination of whether a particular aperture passes ink or not is based upon the image data, and the passing of the ink through a particular aperture is controlled by a transducer. The transducers correspond to the apertures, and activation of a transducer causes ink to be forced through its corresponding aperture onto the print surface.

It is the actuation of these transducers that create the acoustic waves that reverberate through both the fluid dispensing subassembly and back through the fluid supply. The fluid generally moves from the fluid supply to the fluid dispensing assembly that includes the fluid dispensing subassembly and through the fluid dispensing subassembly to the aperture. The acoustic energy transmitted to the reservoir from the fluid dispensing subassembly feeds acoustic energy over a range of frequencies back into the fluid dispensing subassembly. These pressure fluctuations in the fluid dispensing subassembly enhanced by the returning acoustic energy from the reservoirs may result in drop mass or drop speed variations in synchronization with the pressure fluctuations or, in more severe cases, in failure of some jets to eject drops. This in turn results in image artifacts such as banding or image deletions.

For the example of printers, current implementations having issues from the acoustic energy generally introduce some sort of flexible or compliant structure internal to the jet stack.

This may include a flexible membrane or thin film of stainless steel or other substance inside the jet stack with a space on one side of the film to give the film room to flex. The flexing of the film attenuates the acoustic energy, thereby mitigating the pressure wave.

However, the approach of only concentrating on the fluid dispensing subassembly does not cure the issues in the back portion of the fluid path in the fluid dispensing assembly, between the reservoirs and the fluid dispensing subassembly. It is possible to add compliance to the local reservoirs in the fluid dispensing assembly such as a print head, thereby increasing the system's ability to attenuate the acoustic energy so the disruption is minimized.

Figure 2:
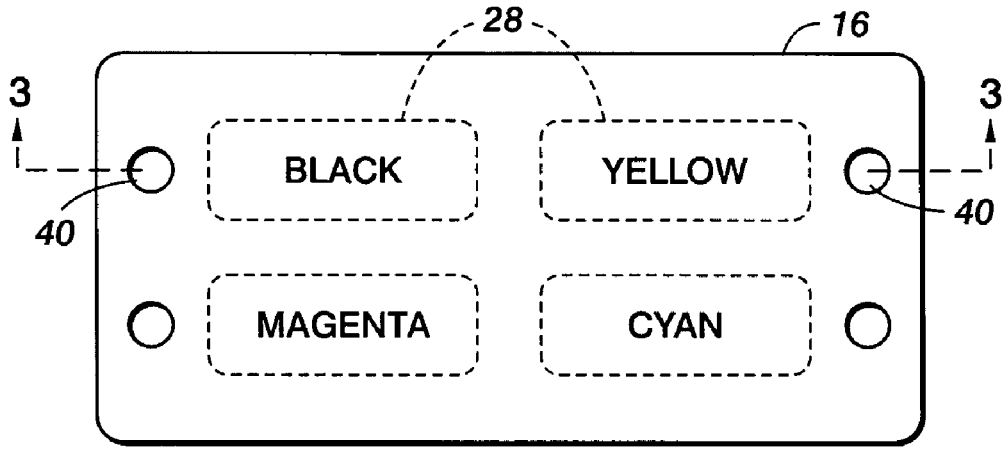
FIG. 2 shows an embodiment of fluid reservoirs sealable by a compliant film.

FIG. 2 shows an embodiment of a reservoir assembly 16. The reservoir assembly contains fluid chambers 28 called reservoir chambers that locally store and route fluid from the fluid supply to the fluid dispensing subassembly within the fluid dispensing assembly. In a printer, there will frequently be 4 reservoir chambers corresponding to the three primary color inks and black ink. The inlets 40 provide a path from the ink supplies to the fluid dispensing subassembly. The dotted lines defining the reservoir chambers indicate that there is a cover over the fluid chambers.

Figure 3:
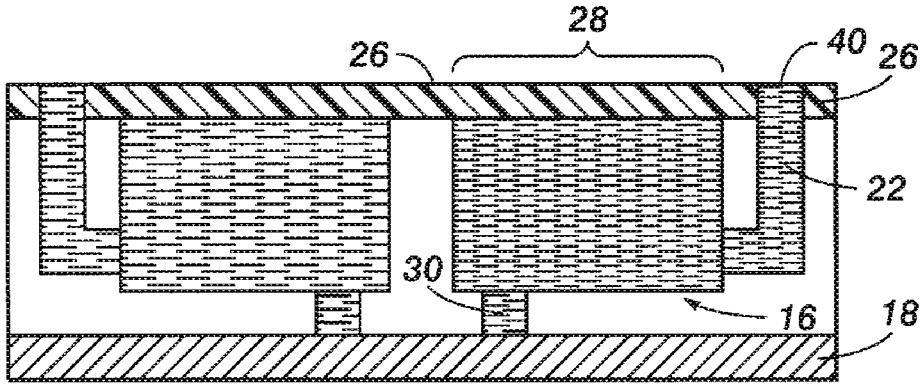
FIG. 3 shows a side view of an embodiment of a fluid path having reservoirs sealed by a compliant film.

A cross-section of the reservoir assembly 16 is shown in FIG. 3. As viewed in FIG. 3, the yellow and black reservoirs and fluid paths would be 'behind' the magenta and cyan paths. The reservoir assembly 16 in this example consists of at least one reservoir chamber structure 28 and a compliant film 26. The reservoir chamber 28 from FIG. 2, for the cyan ink, is facing up relative to the drawing in FIG. 3. The upper portion of the reservoir assembly 16 has a compliant wall 26 over each of the reservoir chambers 28 open to air and at least partially not constrained against flexing. Film 26 would have the openings such as 40 that allow the fluid to enter the fluid path within the reservoir assembly. In other cases, each manifold chamber could have a separate compliant film 26.

The fluid reservoir chambers are closely coupled fluidically to the fluid dispensing subassembly and its transducers that create pressure waves through the manifold subassembly outlets 30. The close coupling results in transmission of disturbances between the reservoir chambers and the fluid dispensing subassembly. As used here, the term 'close coupling' will mean that the fluid reservoirs reside near enough to the fluid dispensing subassembly within the fluid dispensing assembly that they are affected by the disturbances. Attenuation of these pressure disturbances that occur in the fluid at one or the other locations will have effects on the fluid in the other locations.

Generally, current implementations of the assembly 16 would be a structure having a solid and stiff wall covering the reservoir chambers. The set of holes such as 40 allow passage ink to the fluid dispensing assembly from each of the reservoir chambers. For example, in a four color printer, each fluid channels 40 would allow passage of fluid from the supply into the reservoir chambers 28. The holes can be machined into the substrate or more typically, the reservoir chambers may be formed in a part that might be cast aluminum or a molded polymer, the holes may result from the mold or casting.

In order to introduce compliance in the fluid reservoir, the covering structure 26 that seals the reservoir chambers must be compliant.

The other side of the compliant film is at least partially in contact with air, allowing room for the film to flex as needed in response to pressure fluctuations in the ink supply caused by actuation of the transducers. The side of the film sealing the opening will be in contact with the fluids in the reservoir chambers. A more detail view of this arrangement is shown in FIG. 3.

The fluid travels through a first reservoir path 22 from the fluid supply 12 of FIG. 1 to the fluid reservoir chamber 28 within the reservoir assembly 16. The fluid would then travel through the fluid path 30 from the reservoir 16 to the fluid dispensing subassembly 18. The fluid would then be transferred from the fluid dispensing subassembly onto a receiving surface. In the example of a printer, the fluid would be dispensed onto a print substrate, such as paper, film, etc.

The compliant film 26 seals the ink reservoirs 28 on the 'back side' of the fluid dispensing assembly, opposite the location of the fluid dispensing subassembly 18 on the 'front side.' This alleviates pressure disruptions caused in regions of the system other than the fluid dispensing subassembly. This film could consist of many different compliant materials. The material may have a Young's modulus less than 50 GigaPascals (GPa), and maybe even less than 10 GPa.

Examples of compliant materials with these characteristics include polyimide, polycarbonate, polyester, polyetheretherketone, polyetherimide, polyethersulfone, polysulfone, liquid crystal polymer, stainless steel, and aluminum foil. The metal materials would generally be very thin to ensure the necessary flexibility to deflect in response to pressure fluctuations in the ink supply. The compliant film may be bonded to the reservoir plate with an adhesive, such as acrylic, silicone, epoxy, bismaleimide, thermoplastic polyimide, thermoset adhesives, thermoplastic polymers and acrylic thermoset adhesive.

The use of the compliant film in conjunction with the openings in the ink reservoir chambers allows the film to deflect over the openings to adjust for fluctuations in the ink pressure. This deflection creates a damping effect on the pressure waves, preventing some of the harmful effects of the waves, such as banding or jet failure.

Figure 4:
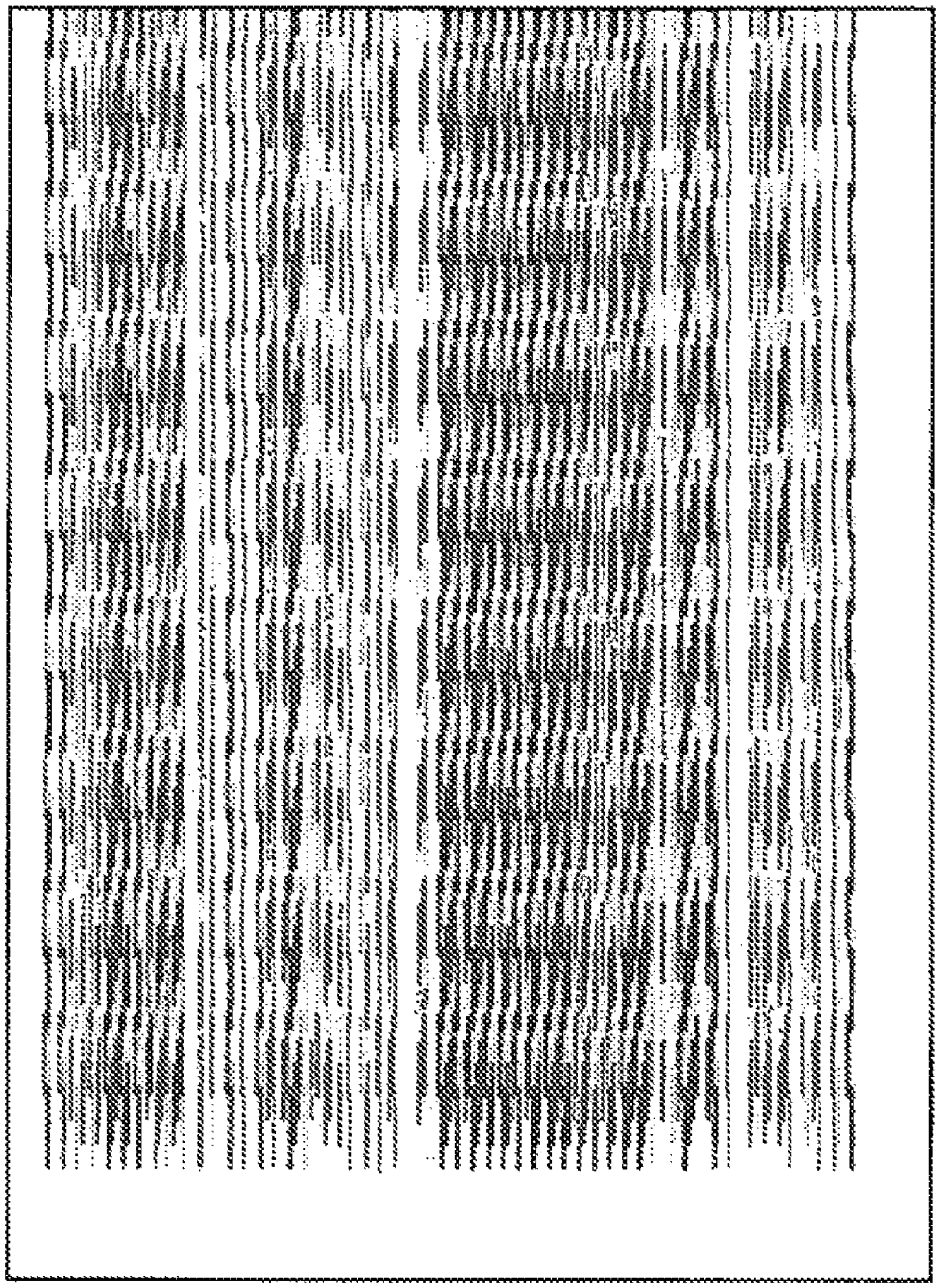
FIG. 4 shows an example of an image having jet failures without a compliant film.

FIG. 4 shows an example image from a system that does not have any compliant structures to attenuate the pressure waves. As can be seen, the white streaks in the image are caused by jet failure or drop out, where the ink supply is disrupted and the ink does not exit the apertures corresponding to the 'unprinted' or white regions.

Figure 5:
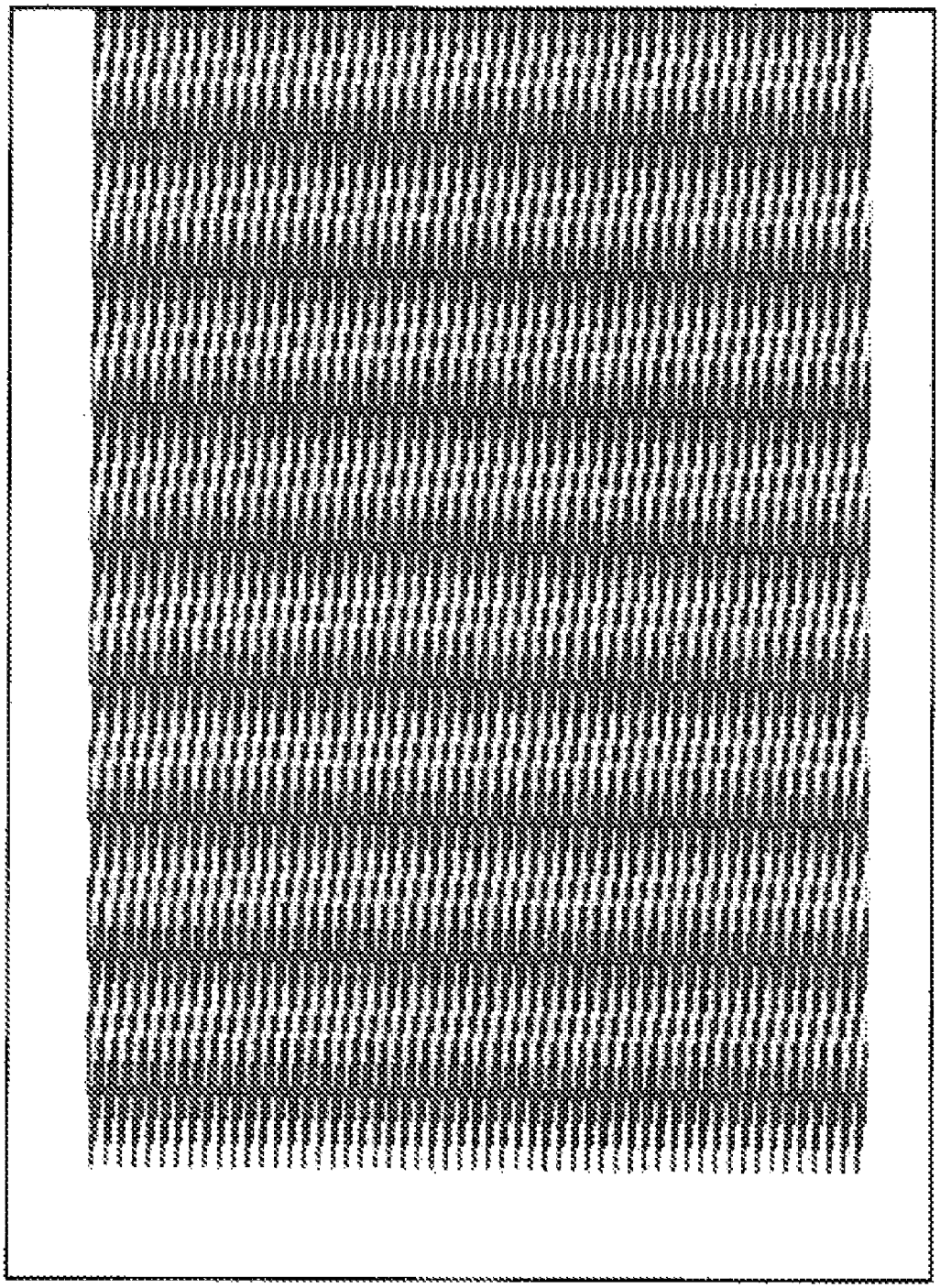
FIG. 5 shows an example of an image formed with a print head having a reservoir compliant film.

In contrast, FIG. 5 shows an example image from a system with a print head having a compliant reservoir wall. As can be seen here, there are no jet failures, as there are no white streaks on the image. All of the jets are functioning under the same conditions of the image in FIG. 4, except that the compliant film has sufficiently dampened the pressure waves that caused the previous jet drop out.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A reservoir assembly, comprising:

a fluid dispensing subassembly having a first compliant film internal to the fluid dispensing subassembly;

a reservoir having at least one opening corresponding to a location of at least one reservoir chamber in the reservoir; and a second compliant film external to the fluid dispensing subassembly arranged to seal the opening and flex in response to pressure fluctuations in the fluid chamber.

2. The reservoir assembly of claim 1, wherein the reservoir assembly is arranged to supply fluid to a manifold with close fluidic coupling to the fluid dispensing subassembly.

3. The reservoir assembly of claim 1, wherein the reservoir assembly comprises one of either a molded polymer plate or a metal plate.

4. The reservoir assembly of claim 1, wherein the compliant film comprises one selected from the group consisting of: polyimide, polycarbonate, polyester, polyetheretherketone, polyetherimide, polyethersulfone, polysulfone, liquid crystal polymer, stainless steel, and aluminum.

5. The reservoir assembly of claim 1, wherein the compliant film is attached to the reservoir assembly using an adhesive selected from the group consisting of: acrylic, silicone, epoxy, bismaleimide, thermoplastic polyimide, and acrylic thermo-set adhesive.

6. The reservoir assembly of claim 1, wherein the compliant film has a Young's modulus of less than 50 GigaPascals.

7. The reservoir assembly of claim 1, wherein the compliant film has a Young's modulus of less than 10 GigaPascals.

8. The reservoir assembly of claim 1, wherein the reservoir assembly comprises a print head in a printer.

9. The reservoir assembly of claim 8, wherein the printer is a solid-ink jet printer.

10. A system, comprising:

a fluid supply; and a reservoir assembly having:

a fluid dispensing subassembly having a first compliant film internal to the fluid dispensing subassembly;

a reservoir having at least one opening corresponding to a location of at least one reservoir chamber in the reservoir; and a second compliant film external to the fluid dispensing subassembly arranged to seal the opening and flex in response to pressure fluctuations in the fluid chamber.

11. The system of claim 10, wherein the reservoir chamber comprises one of either a molded polymer plate or a metal plate.

12. The system of claim 10, wherein the compliant film comprises one selected from the group consisting of: polyimide, polycarbonate, polyester, polyetheretherketone, polyetherimide, polyethersulfone, polysulfone, liquid crystal polymer, stainless steel, and aluminum foil.

13. The system of claim 10, wherein the compliant film is attached to the reservoir plate using an adhesive selected from the group consisting of: acrylic, silicone, epoxy, bismaleimide, thermoplastic polyimide, thermoset polymers, and acrylic thermo-set adhesive.

14. The system of claim 10, wherein the compliant film has a Young's modulus of less than 50 GigaPascals.

15. The system of claim 10, wherein the compliant film has a Young's modulus of less than 10 GigaPascals.

* * * * *